US006739216B2

(12) United States Patent
Oyabu

(10) Patent No.: US 6,739,216 B2
(45) Date of Patent: May 25, 2004

(54) CROWN TIGHTENING TOOL

(75) Inventor: Kimiko Oyabu, Ichinomiya (JP)

(73) Assignee: Corporation Yuubido, Ichinomiya (JP)

( * ) Notice: Subject to any disclaimer, the term of this patent is extended or adjusted under 35 U.S.C. 154(b) by 0 days.

(21) Appl. No.: 10/020,949

(22) Filed: Dec. 19, 2001

(65) Prior Publication Data

US 2002/0078797 A1 Jun. 27, 2002

(30) Foreign Application Priority Data

Dec. 26, 2000 (JP) ..... 2000-395801
Aug. 31, 2001 (JP) ..... 2001-264047

(51) Int. Cl.[7] ..... G04D 3/00
(52) U.S. Cl. ..... 81/6; 81/3.43
(58) Field of Search ..... 81/6, 7.5, 3.4, 81/3.43, 122, 123, 64; 368/206, 214; 968/665, 683

(56) References Cited

U.S. PATENT DOCUMENTS 143,653 A * 10/1873 Allen et al. ..... 81/123
191,338 A * 5/1877 Harris ..... 81/123
224,342 A * 2/1880 Loveren et al. ..... 81/122
763,352 A * 6/1904 Barton ..... 7/138
1,626,730 A * 5/1927 Haynes ..... 81/185
1,640,296 A * 8/1927 Rhoads ..... 81/64
1,924,579 A * 8/1933 Waterhouse ..... 81/3.4
2,003,983 A * 6/1935 Thener ..... 81/3.4
2,023,975 A * 12/1935 Qualey ..... 81/3.4
2,554,410 A * 5/1951 Horton ..... 81/3.4
3,824,881 A * 7/1974 Wright ..... 81/63
5,309,793 A * 5/1994 Tipp ..... 81/3.43
5,533,429 A * 7/1996 Kozak ..... 81/439

* cited by examiner

*Primary Examiner*—Hadi Shakeri
(74) *Attorney, Agent, or Firm*—Armstrong, Kratz, Quintos, Hanson & Brooks, LLP

(57) ABSTRACT

A crown tightening tool is constituted by an engaging part which can be engaged with a crown projected form a watch body of a wristwatch, and a handle part which is engaged with the engaging part and rotates the engaging part. The engaging part is formed by grooves to engage and rotate the crown. The crown tightening tool can be worn by a user as an accessory.

5 Claims, 8 Drawing Sheets

CROWN TIGHTENING TOOL

BACKGROUND OF THE INVENTION (1) Field of the Invention

The present invention relates to a crown tightening tool of a wristwatch, and more specifically to a crown tightening tool where an owner of a water-proof watch can tighten a crown of the waterproof watch.

(2) Description of the Prior Art

In wristwatches, that of the automatic winding type, that of the manual winding type, and that of the water-proof type are known. In these watches, a crown to move hands is coupled by screws so as to move the hands of the watch and is arranged to the body of the watch. After the adjustment of the hands, adjustment of the date and the like are performed in the manufacturing process, the watch is provided as a finished product to customers.

A crown is arranged projecting from the body so that while the user uses the watch, the user can operate the crown for the adjustment of the hour or the date or the operation of other functions.

On the other hard, in a water-proof watch, the watch is assembled with a packing or the like enclosed therein so that water does not enter the watch, and the watch is constituted in a sealed structure so that while the watch is worn by a user, for example, the user can enter a bath or can dive in a sea. However, since a crown is constituted to rotate by operation of the user, even in a water-proof watch, if tightening of the crown is not complete, water may enter from a surrounding area of the crown. Therefore the crown must be tightened firmly.

In the state that water enters the water-proof watch due to insufficient tightening of the crown, the watch must be repaired, and the cost for the repair must be borne by the user himself. Consequently the tightening work of the crown must be performed carefully.

In some cases, tightening by hand is not performed but a general tool is used. In the general tool, however, the crown itself and its adjacent areas are liable to be damaged, and the value of the watch may be decreased.

In the prior art, as shown in FIG. 18, a pair of pliers 50 to tighten a crown in a manufacturing process is known (refer to JU-A 55-175895). However, the pair of pliers 50 is mainly used to assemble the crown to the winding shaft when the watch is assembled. A crown tightening tool does not exist to tighten a crown assembled to and projecting from the watch body.

Further, in some watches, in order to protect a crown, a wall part as a crown guard is formed at one sine of the crown. In this case, in the pliers 50 in the prior art as shown in FIG. 18, a grasping part for grasping at the top end of the crown can not be inserted within the wall part as the crown guard and the crown can not be grasped. Consequently, in the assembled watch, the pliers 50 can not he used in the case that the projection amount of the crown from the body of the watch small, or in a wristwatch where a crown guard formed.

SUMMARY OF THE INVENTION

An object of the present invention is to solve the above-mentioned problems, and to provide a crown tightening tool which can tighten a crown sufficiently in order to improve the waterproofing effect of a water-proof watch, which does not damage the crown, which is readily used, which can tighten the crown of many brands of watches, and further which has ornamental and design features.

In order to solve the above-mentioned problems, a crown tightening tool according to the present invention is constituted as follows.

A crown tightening tool to tighten a crown of a wristwatch, where the crown tightening tool is provided with an engaging part for engaging with the crown in the projected state from a watch body, with an operation handle part arranged to be put on taken off the engaging part, and formed linearly.

The engaging part is provided with a fitting recess to be engaged with all or a part of grooves formed on an outer circumferential surface of the crown, and with a handle engaging part for engaging with the operation handle part. The operation handle part is rotated along the axial center, thereby rotating the crown.

A crown tightening tool of the present invention, in above-mentioned constitution, is engaged with a crown projected from a watch body in order that a crown can be tightened securely when it can not be sufficiently tightened in by hand. Thus in the case of a water-proof watch, since the crown can be tightened to a prescribed position, the water proving effect can be improved. Also since a non-engaging end of the engaging part is formed to be put on and taken off the operation handle, the operation handle as rotated in one direction and the crown can be rotated through the engaging part along the axial center. The tightening work can be performed quite easily even by a person who is not strong.

Also, the crown tightening tool is that to tighten the crown of the wristwatch, is provided with an engaging part capable of being engaged with the crown in the projected state from the watch body, with an operation handle part arranged to be put on and taken off the engaging part, is formed linearly, and the engaging part has a recess molded on the outer circumferential surface of the crown. A thermoplastic resin is filled in the recess and is fitted to the crown at a high temperature state to form a female die of the crown in the recess.

Consequently when the thermoplastic resin filled in the engaging part of the crown tightening tool is at a high temperature state and is pushed to the crown, the female die of the crown can be molded in the thermoplastic resin. Thus or any crown, a crown tightening tool corresponding to various brands of watches can be provided.

Also, when an operation handle part is formed in a long pin shape and a small hole is formed in one end, for example, a neck string can be inserted in the small hole and the crown tightening tool having the engaging part engaged with the operation handle part can be worn as an accessory to the user.

Further, the crown tightening tool to tighten a crown of a watch, and which has an engaging part capable of being engaged with the crown in the projected state from the watch body and is constituted to be capable of being put on and taken off the crown, has a pair of plates arranged in parallel with respect to the crown as an engaging part, and the pair of plates are installed to be mutually slidable relative to each other. The pair of plates hold the crown and the plates are moved in reverse directions respectively, thereby the crown can be rotated arid tightened.

Therefore, the crown is engaged with the pair of slideable plates and thereby the crown can be tightened. The crown tightening tool can be used for a wristwatch with a crown guard formed and can be used for various watches having different crown shapes. Moreover, the engaging part formed in the shape of a pair of plates is worn by the user, thereby the crown tightening tool can be used as an accessory to the user in addition to functioning as a tool.

Also, locking grooves are formed on the surfaces opposite to the crown in the pair of plates, and they can be engaged with the grooves formed on the outer circumferential surface of the crown. Consequently, when the pair of plates are slid, the locking grooves can be engaged with the grooves of the crown and the crown can be tightened sufficiently. Therefore, in the case of a water-proof watch, the water-proofing effect can be improved.

Further, since the pair of plates are formed having elastic material with the energizing force acting in the direction pulling them, toward each other, when the crown tightening tool is engaged with the crown, the crown can be easily held, and the tightening operation of the crown can be performed easily.

Also, the crown tightening tool to tighten a crown of a watch, having an engaging part capable of being engaged with the crown in the projected state from the watch body and constituted to be put on and taken off the crown, is provided with a pair of plates arranged in parallel with respect to the crown, and the pair of plates are formed in an endless state with both ends. The pair of plates hold the crown and are moved in one direction thereby the crown is rotated.

Consequently, the engaging part is engaged with the crown and then is moved to rotate in one direction, thereby the tightening operation of the crown can be performed easily. Also, since the crown can be tightened to hold the two opposite surfaces, the crown tightening tool can be used with a wristwatch with a crown guard formed. Moreover, when the crown tightening tool formed in the endless state is worn as a bracelet, it can be used as an accessory or the user.

Also, in the pair of plates, since a locking groove is formed and can be engaged with grooves formed on the outer circumferential surface of the crown, when the locking groove is engaged with the crown and moved to rotate in one direction, the crown can be tightened sufficiently, and in the case of a water-proof watch, the water proving effect can be improved.

DESCRIPTION OF THE PREFERRED EMBODIMENTS

Figure 1:
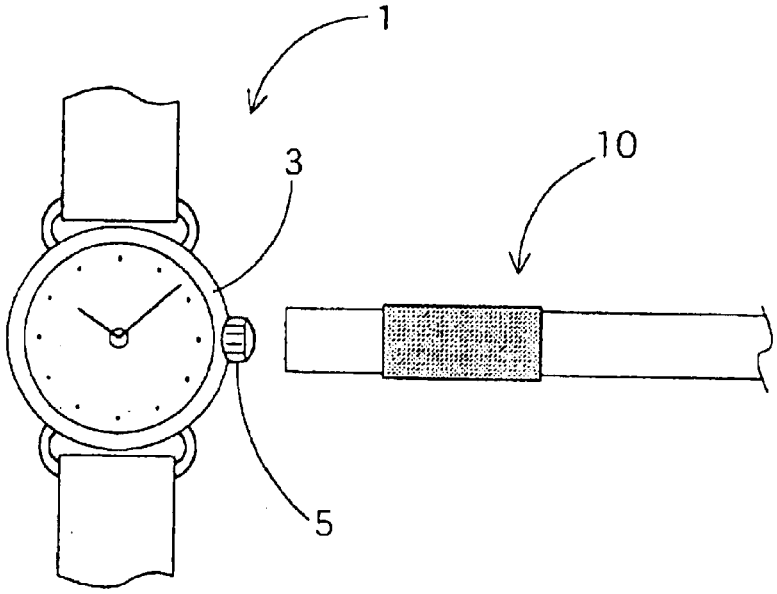
FIG. 1 is a front view showing a crown tightening tool installed on a wristwatch crown.

An embodiment of the present invention will be described referring to the accompanying drawings as follows. A crown tightening tool shown in FIG. 1 is provided with an engaging part for engaging with a crown 5 protecting from a body 3 of a wristwatch 1 and is positioned on the crown 5. The crown 5 is rotated in one direction, thereby the crown 5 is screwed and tightened into the body 3.

Figure 2:
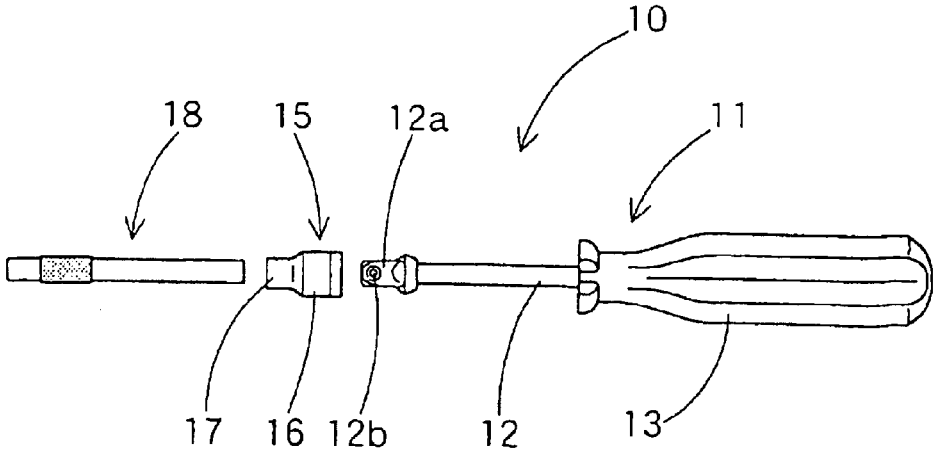
FIG. 2 is an exploded assembling diagram showing a first embodiment.

A crown tightening tool 10 of the first embodiment, as shown in FIG. 2, is provided with an operation handle body (operation handle part) 11, a connection attachment 15 and a crown engaging part 18, the embodiment being a socket wrench type.

The operation handle body 11 has a stem 12 made of iron or stainless steel, and a handle part 13 made of a resin material with a groove part being fixed at one end side of the stem 12. At the top end part of the stem 12, a mounting part 12*a* is formed to install an attachment 15. The mounting part 12*a* is formed in square column shape and in one surface or two surfaces of the mounting part 12*a*, a lock member 12*b* of spheric shape is pushed by a spring (not shown) and is arranged to be put on and taken off the surface of the mounting part 12*a*. In the operation handle body 11, an operation handle body of a socket wrench may be used.

Figure 3:
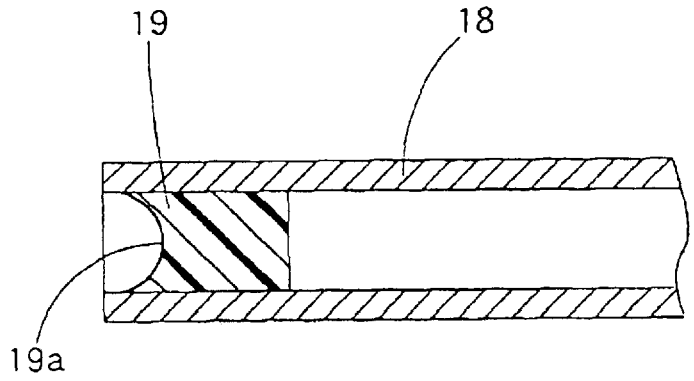
FIG. 3 is a sectional view showing a crown engaging part shown in FIG. 2.
Figure 4:
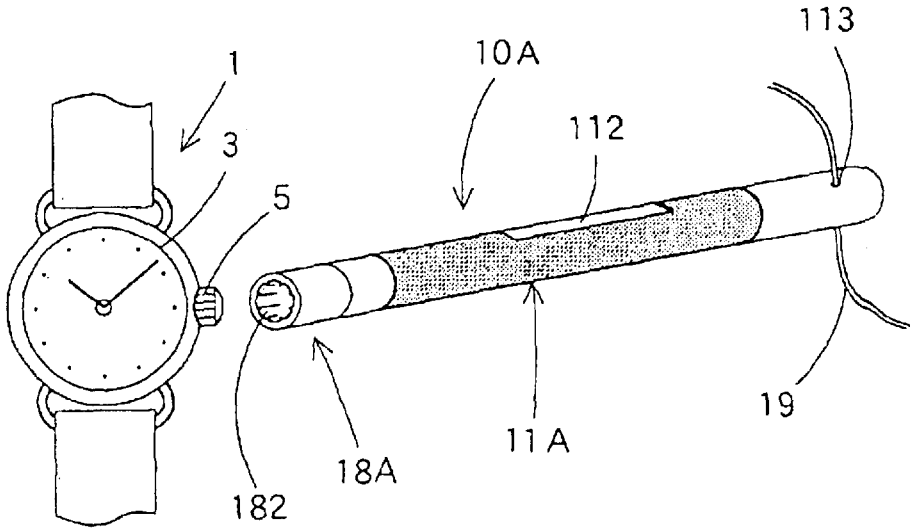
FIG. 4 is a perspective view showing another crown tightening tool of the first embodiment.

The attachment 15 is provided at one end with a socket part 16 externally fitted to the mounting part 12*a* of the stem 12, and at other end with a recess 17 externally fitted to one end of a crown engaging part 18 so as to be put on and taken off. As long as the recess 17 has a shape for fitting to a shape of the crown engaging part 18 at one end and the crown engaging part 18 can be arranged so as to be put on and taken off, the shape of the recess 17 is not limited. Also, the attachment 15 is provided with various sizes depending on the size of the crown engaging part 18. Consequently, size of any of the attachments 15 are formed in the same size as the socket part 16, and the size of the recess 17 is formed in various sizes depending on the size of the crown engaging part 18. In the crown engaging par, 18, in the present embodiment, a thin pipe made of aluminum, iron or stainless steel having relatively high strength used. One end is formed to be fitted to the attachment 15 so as to be put on and taken off, and at one end, as shown in FIG. 3, a crown female die 19*a* made of a thermoplastic resin material 19 is formed in a recess at a too end of the pipe. The crown female die 19*a* is formed by providing the thermoplastic resin material 19 in the top end part of the pipe at a high temperature state and inserting a crown 5 of the prescribed wristwatch 1 along the axial center direction from the head part side. After the female die 19*a* of the crown 5 is formed at the high temperature state, the thermoplastic resin is cooled to a low temperature and hardened thereby to form the female die 19*a*. When dies of various sizes corresponding to the crown 5 of various brands of the wristwatch 1 are previously formed and stored, the crown 5 can be tightened for various brands of the wristwatch 1.

In addition, the crown engaging part 18 and the attachment 15 are integrated and various sizes may be formed so that one end of the crown engaging part 18 can be engaged with the recess 17 of the attachment 15. Further the attachment may not be used and the crown engaging part 18 may be installed directly to the operation handle body 11.

The crown tightening tool 10 according to the first embodiment as described above, is used for tightening the crown 5 firmly when a user dives in water or enters a bath in the state that a water-proof watch 1 is put on an arm, and in the winding operation in an automatic winding wristwatch, and further in the adjustment of the hour, adjustment of the date or other functions. When the crown tightening tool 10 is used, the female die 19*a* of the crown engaging part 18 is arranged in opposition to the crown 5 and is inserted along the axial center of the crown 5 from the head side. Since the female die 19*a* is fitted to the size of the crown 5, the crown engaging part 18 is inserted and the operation handle body 11 is rotated thereby the crown 5 projecting from the watch body 3 can be tightened firmly.

Also, when the operation handle body 11 constitutes a ratchet mechanism rotatable in one direction and a prescribed torque can be set, the crown 5 can be tightened to the prescribed torque and the watch is not damaged due to excessive tightening.

In addition, when a skid proof tape is wound on the crown engaging part 18, the crown can be tightened without installing the crown engaging part 18 to the operation handle body 11.

In addition, the crown tightening tool of the first embodiment having the engaging part capable of being engaged with the crown 5 and an operation handle body formed to be capable of being put on and taken off through the attachment, is not limited to that shown in FIG. 2, but can also be as shown in FIGS. 4 to 9. A crown tightening tool 10A provided with a handle part 11A formed in a long round pin shape (or long square pin shape) and arranged to be put on and taken off an engaging part 18A, with an engaging part 18A having a recess capable of being engaged with the crown 5, may a so be used.

Figure 5:
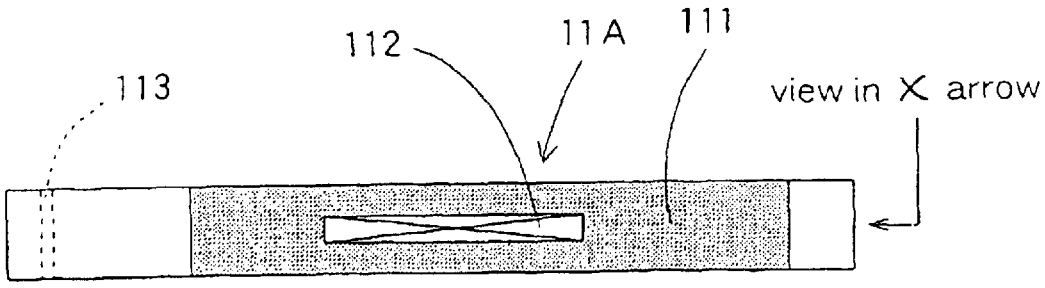
FIG. 5 is a plan view showing a handle part of the crown tightening tool shown in FIG. 4.
Figure 6:
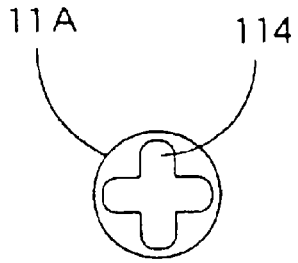
FIG. 6 is a view in a direction of an X arrow shown in FIG. 5.

The handle part 11A as shown in FIGS. 5 and 6, is formed in a long round pin shape, and at the center part in a width dimension, a knurling treatment part 111 as skid prevention is applied for easy operation by hand. A slender plane part 112 is formed at a part of the center of the knurling treatment part 111. Further, at one end side of the handle part 11, For example, a small hole 113 is formed to penetrate in the diameter direction and a neck string may be inserted in the small hole 113.

Also, on the end surface at the opposite side of the small hole 113, as shown in FIG. 6, an engaging recess 114 of cross shape is formed and can be engaged with the engaging part 18A. In addition, in the slender plane part 112, a name of a watch maker is written. When a wristwatch of an exclusive maker is used, a crown tightening tool 10A with an engaging part 18A having the maker written on the handle part 11A may be provided.

Figure 7:
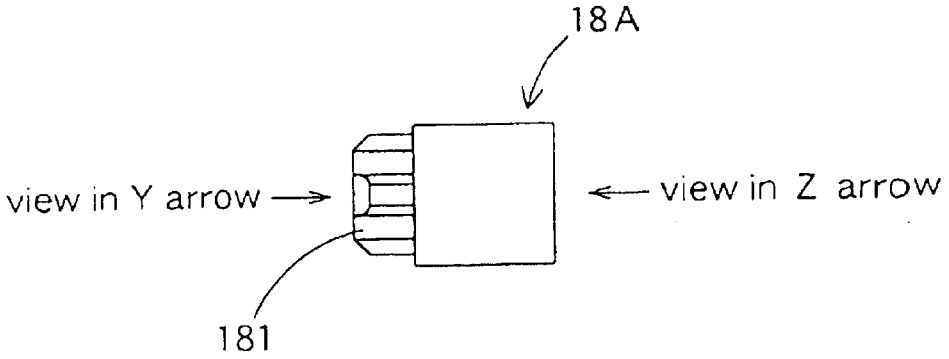
FIG. 7 is a front view showing an engaging part as shown in FIG. 4.
Figure 8:
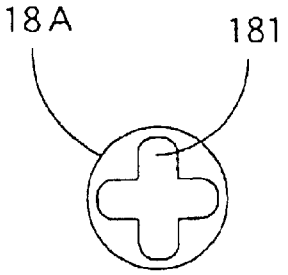
FIG. 8 is a view in a direction of a Y arrow as shown in FIG. 7.
Figure 9:
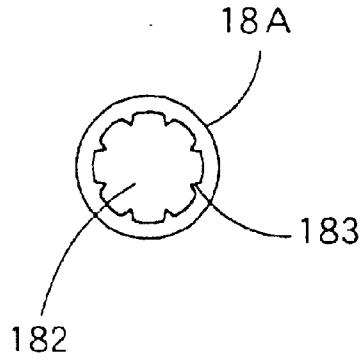
FIG. 9 is a view in a direction of a Z arrow as shown in FIG. 5.

The engaging part 18A is used as an attachment for each exclusive watch maker, and as shown in FIGS. 7 to 9, it is formed by a material softer than the crown 5, for example, resin, duracon or the like, the engaging part has an outer diameter nearly equal to that of the handle part 11A. One end of the engaging part 18A has an engaging projection 181 which is formed in a cross shape capable of being fitted to the engaging recess 114 of the handle part 11A (refer to FIG. 8), and other end of the engaging part 18A has an engaging recess 182 which can be engaged with the crown 5 (refer to FIG. 9). The engaging recess 182 may be provided with an inner groove in the same shape as that of a number of the projection grooves formed on the outer circumferential surface of the crown 5, and as shown in FIG. 9, an engaging projection 183 may be formed within the engaging recess 182. The engaging projection is divided in six or eight and can be engaged with a number of grooves of the crown.

In the crown tightening tool 10A, the engaging projection 181 of the engaging part 18A is engaged with the engaging recess 114 of the handle part 11A and integrated, and the engaging recess 182 of the engaging part 18A is fitted to the outer circumference of the crown 5. The crown 5 can be rotated, and adjustment of the hand, adjustment of the date and adjustment of other functions can be performed.

Figure 10:
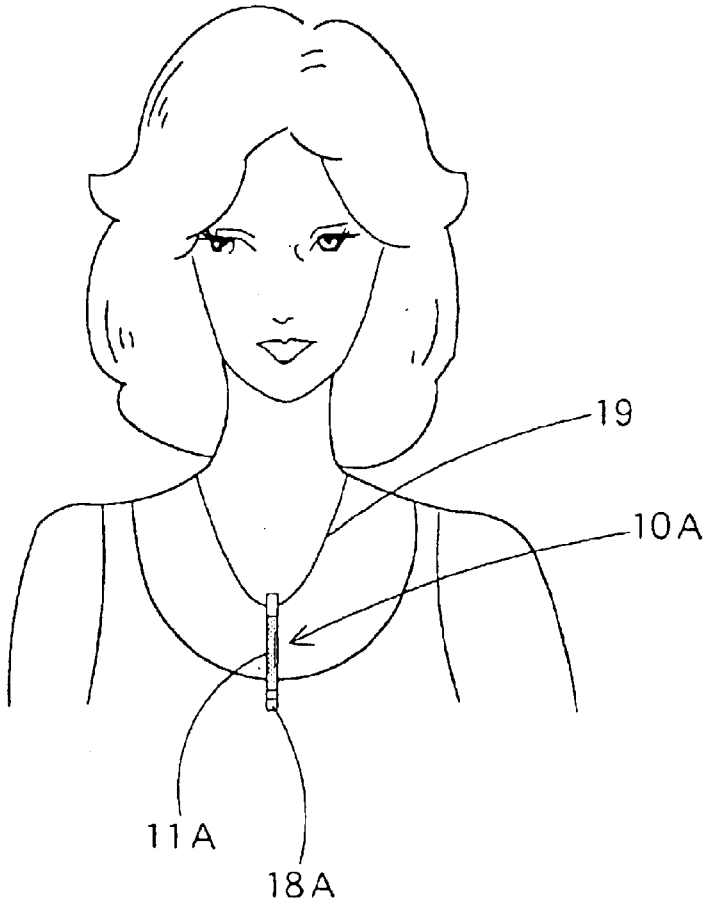
FIG. 10 as a front view showing the crown tightening tool shown in FIG. 4 being used as an accessory.
Figure 11:
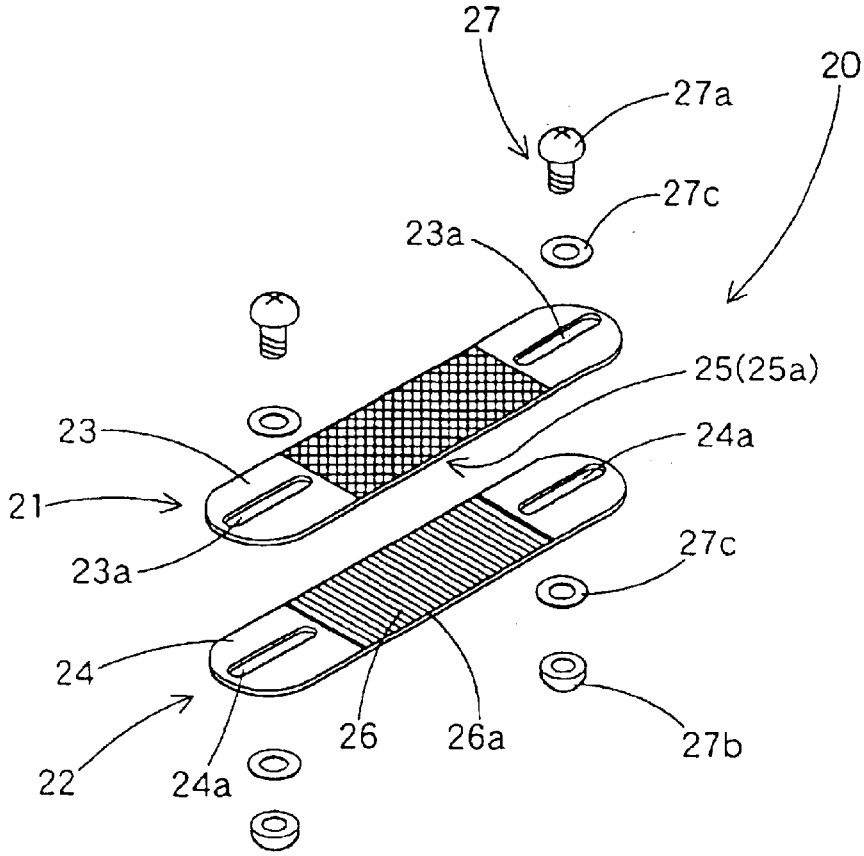
FIG. 11 is a perspective view showing a crown tightening tool of a second embodiment.

When the crown 5 is not being tightened by the crown tightening tool, as shown in FIG. 10, if a neck string 19 is inserted in the small hole 113 formed on the handle part 11A, the crown tightening tool can be hung on the user neck and used as a pendant. Particularly, when the handle part 11A or the engaging part 18A is formed from precious metals such as K18-carat gold, patina, K18-carat white gold or the like, the pendant becomes further valuable as an accessory. Further the fitting recess 182 can be used as a whistle when the fitting recess 182 is formed in the handle part 11A and the user blows through one end. In case of a dangerous state, the whistle can be blown so as to summon help. A crown tightening tool 20 of a second embodiment, as shown in FIG. 11, comprises a pair of engaging plates 21, 22 arranged with respect to a crown 5 and capable of holding the crown 5. The pair of engaging plates 21, 22 are constituted in that elastic plates 23, 24 are thin and are made of iron or stainless steel. Rubber plates 25, 26 provided as a crown engaging part having a number of locking grooves 25*a*, 26*a* for engaging with a longitudinal groove 5*a* of the crown 5 are applied toward the opposite sides with respect to a center part, and on both ends, oval holes 23*a*, 24*a* are formed along the longitudinal direction. A screw set 27 coupling the pair of elastic plates 23, 24 is installed to each of the oval holes 23*a*, 24*a*.

For the slidable installation at both ends of the pair of engaging plates 21, 22, the screw set 27 includes a machine screw 27*a* for penetrating the oval holes 23*a*, 24*a*, a nut 27*b* for attaching to the machine screw 27*a* and a washer 27*c*. When a dimension between a read part of the machine screw 27*a* and the nut 27*b* is made larger than thickness of the pair of elastic plates 23, 24 the elastic plates can be moved in relation to each other.

Figure 12:
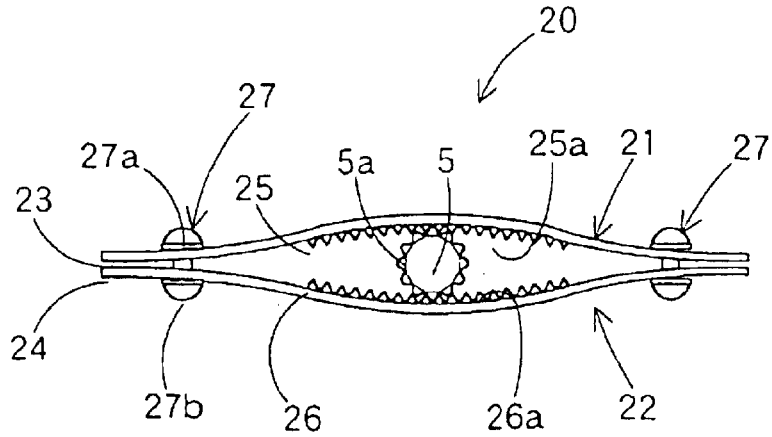
FIG. 12 is an assembling diagram of the crown tightening tool shown in FIG. 11.

Consequently the pair of engaging plates 21, 22 are mounted to be slidable with each other by virtue the oval holes 23*a*, 24*a*. The elastic plates 23, 24 have the energizing force so that when the elastic plates 23, 24 are bent with respect to a plane defined by a space between the plates when not deformed, they are apt to restore to the plane. Therefore if the length of the machine screw 27*a* of the screw set 27 is shorter than the width of the crown 5, as shown in FIG. 12, the pair of elastic plates 25, 26 are deformed so that the portion engaging with the crown 5 is projected to be swelled in comparison with the portion engaged by the screw sets 27 at both ends. Since the elastic plates 23, 24 have the energizing force toward the plane, the elastic plates 23, 24 are pushed in the direction holding the crown 5. Installation is performed by engaging the longitudinal grooves 5*a* of the crown 5 with the locking grooves 25*a*, 26*a* of the rubber plates 25, 26.

Figure 13:
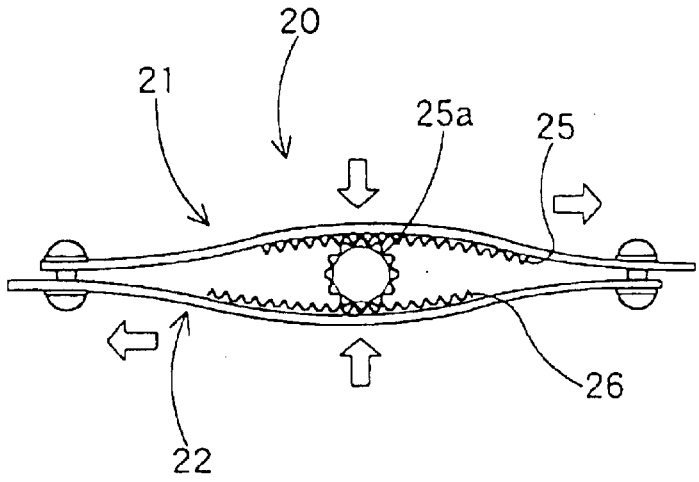
FIG. 13 is a function diagram showing the crown tightening tool shown in FIG. 12 being slid.

Consequently, as shown in FIG. 13, when locking grooves 25*a*, 26*a* of a pair of rubber plates 25, 26 are engaged with the longitudinal grooves 5*a* of the crown 5 and a pair of engaging plates 21, 22 are mutually slid along the oval holes 23*a*, 24*a*, the crown 5 is screwed toward the direction to be tightened. This can be repeated in order that the crown 5 can be tightened to the prescribed force. In this case, the crown 5 is engaged with the rubber plates 25, 26, and since the frictional resistance is high, slipping does not take place and the crown 5 is easily rotated.

Figure 14:
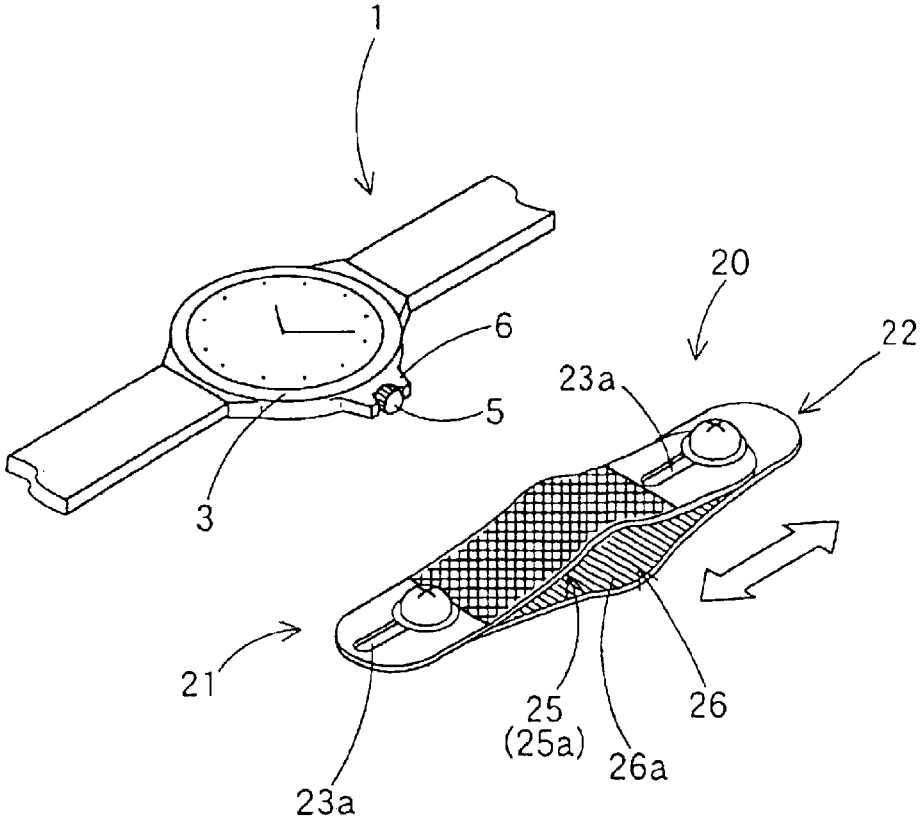
FIG. 14 is a perspective view showing a tightening function of a crown in a wristwatch where a crown guard is formed; the crown tightening tool being the second embodiment.

Since the crown tightening tool 20 in this embodiment is installed in parallel to the opposite surfaces of the crown 5, as shown in FIG. 14, it is suitable to tighten a wristwatch (water-proof watch) 1A in which a crown guard 6 is formed. Since a gap between the wall of the crown guard 6 and the crown 5 is made quite small, for example, the crown tightening tool 10 having the wall surrounding the whole circumference of the crown as in the first embodiment, the engaging part can not be inserted between the wall of the crown guard 6 and the crown 5. Consequently, even if the wall of the crown guard 6 is arranged in only one direction, and the direction orthogonal to this is clear, the engaging plates 21, 22 can be arranged in the clear position and the crown can be tightened.

In addition, in the crown tightening tool 20 in this embodiment, if skid preventing means is applied to opposite surfaces of the rubber plates 25, 26, and in the elastic plates 23, 24 are slid by hand, the crown tightening tool 20 can be slid sufficiently. If the locking grooves 25*a*, 26*a* are formed on the surface opposite to the crown 5, the elastic plates 23, 24 and the rubber plates 25, 26 may be formed integrally with the elastic plates or may be formed integrally with the rubber plates.

Further since the crown tightening tool 20 in this embodiment can be worn by the user and used as an accessory, it is suitably possessed by a woman.

Figure 15:
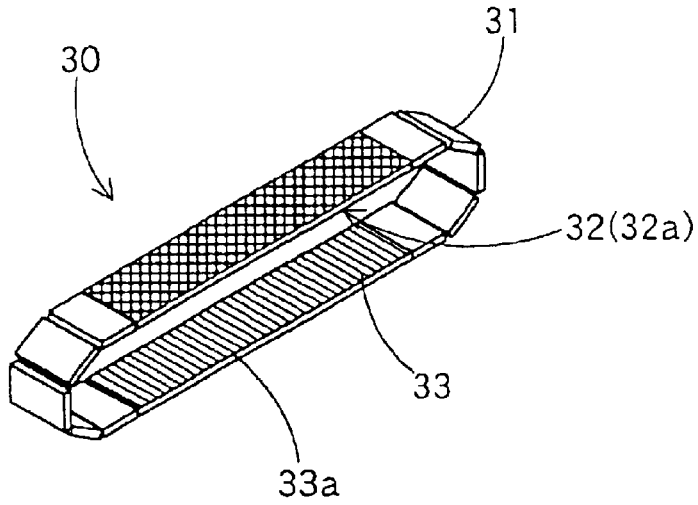
FIG. 15 is a perspective view showing a crown tightening tool of a third embodiment.
Figure 16:
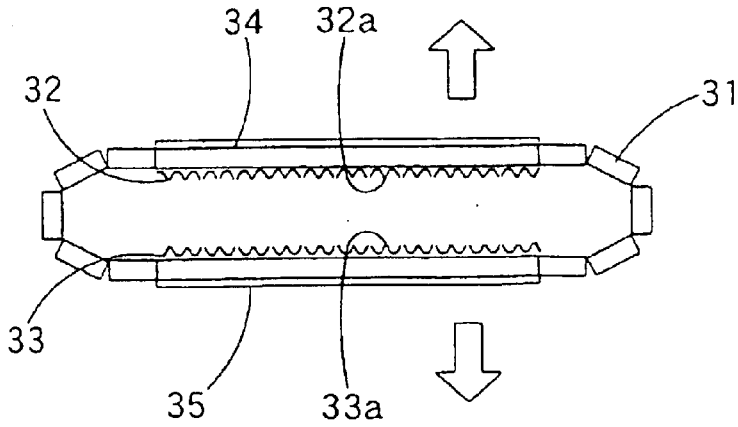
FIG. 16 is a front view showing the crown tightening tool of the third embodiment shown in FIG. 15.

In a crown tightening tool 30 of a third embodiment, as shown in FIGS. 15 to 16, a band member 31 having two opposite linear surfaces are formed as a ring member in endless state, and a pair of rubber plates 32, 33, as a crown engaging part, are installed along opposite surfaces in the linear direction. In the rubber plates 32, 33, a number of locking grooves 32*a*, 33*a* are formed and are engaged with the longitudinal grooves 5*a* formed in the crown 5. The band member 31 is preferably formed by a number of single rectangular plates connected in an elastic state and formed in an expandable state along the longitudinal direction, as known in a band of a conventional watch. In the band member 31, on the surface side opposite to the surface on which the rubber plates 32, 33 are installed, thin plates 34, 35 with a skid preventing means are applied.

Figure 17:
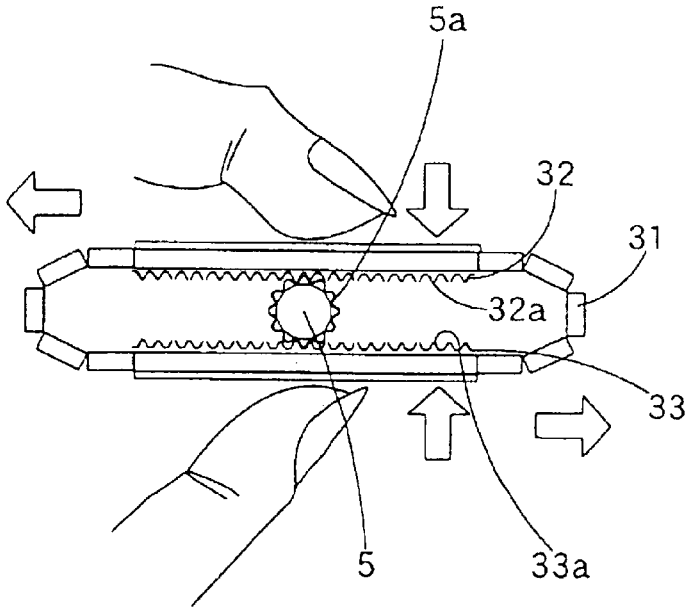
FIG. 17 is a front view showing functioning of the crown tightening tool of the third embodiment shown in FIG. 16.
Figure 18:
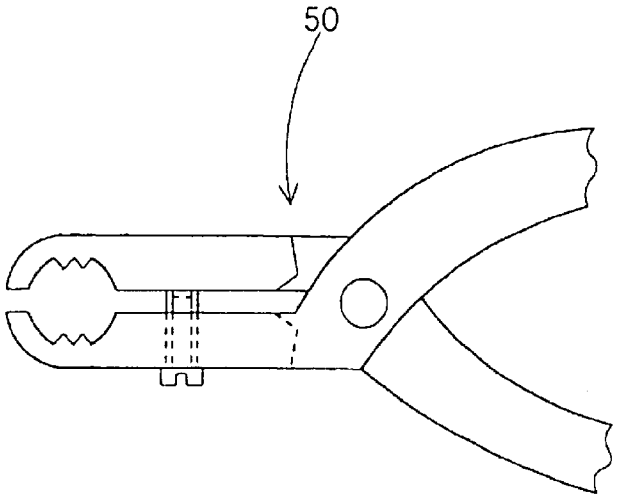
Fig. 18 Prior Art
FIG. 18 is a schematic diagram showing a crown tightening tool (pliers) of the prior art.

The crown tightening tool 30 is engaged on both opposite surfaces of the crown 5 of the wristwatch 1, in a manner similar to the crown tightening tool 20 of the second embodiment, and the locking grooves 32*a*, 33*a* are arranged to the longitudinal grooves 5*a* of the crown 5 at. As shown in FIG. 17, if fingers are positioned on the thin plates 34, 35 with the skid preventing means applied, the locking grooves 32*a*, 33*a* and the longitudinal grooves 5*a* are engaged with each other and after rotation of the crown crowning one direction, the crown 5 is tightened.

The crown tightening tool 30 of this embodiment can be suitably used on a wristwatch where the crown guard 6 is formed, in a manner similar to the crown tightening tool 20 of the second embodiment. Further since the crown tightening tool 30 is formed in the ring shape, when it is put on an arm of the user, it can be used as a bracelet and is suitably possessed by a woman.

In place of the band member of a ring shape in endless form, the locking grooves 32*a*, 33*a*, as a crown engaging part, may be arranged at the rear surface side of the opposite linear surfaces, and an iron plate with the skid preventing means applied, or a rubber plate or a plate formed by other material may be arranged at the front surface side, and semicircular ring parts on both ends may be coupled by the band member 31.

As above described, the crown tightening tool is engaged on the crown 5 protecting from the watch body 3, and the crown 5 can be tightened securely when it can not be sufficiently tightened by hand. Thereby, in the case of the water-proof wristwatch 1, since the crown 5 can be tightened to the prescribed tightness, the waterproofing effect can be improved.

Also, when the crown engaging part 18 of the crown tightening tool 10 is formed to be put on and taken off the operation handle body 1, the crown engaging part 18 can be engaged along the axial center of the crown 5 and the tightening work can be performed quite easily.

When the thermoplastic resin 19 is filled in the crown engaging part 18 of the crown tightening tool 10, in the state that the thermoplastic resin 19 is filled in the crown engaging tool 10, and the thermoplastic resin 19 heated to a high temperature, if the thermoplastic resin 19 is pushed to the crown 5, the crown female die 19*a* can be molded in the thermoplastic resin 19 and the crown tightening tool 10 can be fitted to various brands of watches.

Further, if the handle part 11A is formed in a long round pin shape and a small hole 113 is formed in one end part, for example, when a neck string is inserted in the small hole 113, the crown tightening tool as having the engaging part 18A engaged with the handle part 11A can be worn as an accessory The crown tightening tool 20 has a pair of engaging plates 21, 22 arranged in parallel with each other and formed to be slidable in relation to each other, and since the crown 5 can be tightened by only being engaged with two opposite surfaces of the crown 5, the crown tightening tool 20 can be used for various brands of watches having different shapes for the crown 5. Moreover, a pair of engaging plates 21, 22 formed in plate shape can be attached to the body of the user thereby the function as the tool is not being used and it can be used as an accessory.

If the locking grooves 25*a*, 26*a* to be engaged with the longitudinal grooves 5*a* of the crown 5 are formed on rubber plates 25, 26 of the crown tightening tool 20, when a pair of engaging plates 21, 22 are slid, the crown 5 can be tightened sufficiently, and in the case of the water-proof watch 1, the water proofing effect can be improved.

Also if a pair of elastic plates 23, 24 are formed by an elastic member energizing in the direction pulling them toward each other, when the crown tightening tool 20 is engaged with the crown 5, since the crown is always held securely, the tightening operation of the crown 5 can be performed easily.

Also If the crown tightening tool 30 is formed in an endless state including the rubber plates 32, 33 for engaging with the crown 5, after engaging with the crown 5, the band member 31 can be moved to be rotated in one direction, and the tightening operation of the crown 5 can be performed easily. Moreover if the crown tightening tool 30 formed in an endless state similar to a bracelet it can be put on an arm and used as an accessory by the user.

If the locking grooves 32*a*, 33*a* to be engaged with the longitudinal grooves 5*a* of the crown 5 are formed on the rubber plates 32, 33 of the crown tightening tool 30, the crown 5 can be tightened sufficiently, and in the case of the water-proof watch 1, the waterproofing effect can be improved.

What is claimed is:

1. A crown tightening tool to tighten a crown of a wristwatch, comprising:

a pair of engaging plates each of said engaging plates having two ends and each end having a slot, said pair of engaging plates being slidably connected to each other at each of said ends by a fastener extending through a respective pair of said slots;

each of said engaging plates including an engaging surface for engaging and rotating the crown when said engaging plates are mutually moved in reverse directions.

2. A crown tightening tool as set forth in claim 1, wherein said engaging surfaces include locking grooves for engaging the crown.

3. A crown tightening tool as set forth in claim 2, wherein said plates are made of an elastic material.

4. A crown tightening tool to tighten a crown of a wristwatch, comprising:

a pair of parallel engaging plates made of rubber, each of said engaging plates having two ends, said pair of engaging plates being connected to each other at said ends by band members to define an endless state, said band members being formed by a number of single rectangular plates;

each of said engaging plates including an engaging surface for engaging and rotating the crown when said engaging plates are moved in opposite linear directions.

5. A crown tightening tool as set forth in claim 1, wherein said engaging surfaces include locking grooves for engaging the crown.

* * * * *